US010794060B1

(12) United States Patent
Ramsey

(10) Patent No.: US 10,794,060 B1
(45) Date of Patent: Oct. 6, 2020

(54) SNOW RAKE

(71) Applicant: Mark C. Ramsey, Omaha, NE (US)

(72) Inventor: Mark C. Ramsey, Omaha, NE (US)

( * ) Notice: Subject to any disclaimer, the term of this patent is extended or adjusted under 35 U.S.C. 154(b) by 0 days.

(21) Appl. No.: 16/742,373

(22) Filed: Jan. 14, 2020

Related U.S. Application Data

(63) Continuation-in-part of application No. 16/130,216, filed on Sep. 13, 2018.

(51) Int. Cl.
*E04D 13/10* (2006.01)
*B08B 1/00* (2006.01)

(52) U.S. Cl.
CPC ..... *E04D 13/106* (2013.01); *B08B 1/005* (2013.01)

(58) Field of Classification Search
CPC ..... E04D 13/106; E01H 5/02; B08B 1/005; A01B 1/00; A01B 1/022; A01B 1/22; A01D 1/14; B25G 1/08; B25G 3/06
See application file for complete search history.

(56) References Cited

U.S. PATENT DOCUMENTS 157,078 A * 11/1874 Parker et al. ..... E01H 5/02 37/274
323,656 A * 8/1885 Franz ..... E01H 5/067 37/274
731,419 A * 6/1903 Wykoff ..... E01H 5/06 37/273
956,896 A * 5/1910 Grozz ..... E01H 5/06 37/273
1,191,810 A * 7/1916 Miller ..... A01B 1/022 294/51
1,276,672 A * 8/1918 Mason, Jr. ..... E01H 5/06 37/273
1,307,410 A * 6/1919 Morris ..... E01H 5/06 37/273
1,746,859 A * 2/1930 Hurd ..... E01H 5/02 37/273
1,771,189 A * 7/1930 Palmer ..... B25G 3/06 403/343
1,820,692 A * 8/1931 Cooper ..... E01H 5/02 37/274
1,896,568 A * 2/1933 Ammons ..... A01B 1/225 403/4
2,429,753 A * 10/1947 Grosch ..... B25G 3/04 403/4
2,432,780 A * 12/1947 Mader ..... E01H 5/02 37/273

(Continued)

*Primary Examiner* — Robert E Pezzuto
*Assistant Examiner* — Joan D Misa
(74) *Attorney, Agent, or Firm* — Dennis L. Thomte; Thomte Patent Law Office LLC

(57) ABSTRACT

The snow rake for removing snow from a roof is disclosed. The snow rake includes an elongated extension pole comprising a plurality of pole sections which may be connected together in an end-to-end manner. First and second rake members are pivotally connected together by a base plate so as to be able to be positioned in a straight position or a V-shaped position. The first and second rake members are also movable to a third position wherein the first and second rake members are positioned so that the inner sides of the rake members face one another. The inner side of the base plate also has extension pole section receptacles formed therein which enable the ends of the pole sections to be positioned therein for shipment or storage purposes.

1 Claim, 10 Drawing Sheets

(56) References Cited

U.S. PATENT DOCUMENTS 2,552,016 A * 5/1951 Rose ..... E01H 5/02 56/400.04
3,431,661 A * 3/1969 Carlson ..... E01H 5/02 37/273
3,526,979 A * 9/1970 Ladewski ..... E01H 5/06 37/273
3,773,375 A * 11/1973 Nehls ..... E04D 13/106 37/268
4,054,313 A * 10/1977 Ciuci ..... A01D 7/00 294/53.5
4,550,943 A * 11/1985 Mirto ..... E01H 5/02 294/50.8
D285,015 S * 8/1986 DiAmico ..... D32/49
RE32,948 E * 6/1989 Lapshansky ..... A01B 1/222 294/51
4,908,900 A * 3/1990 McLaughlin ..... A47L 1/06 15/105
5,465,510 A * 11/1995 Goodnough ..... E04D 13/106 294/54.5
5,511,328 A * 4/1996 Fingerer ..... E01H 5/02 294/54.5
5,791,072 A * 8/1998 Schbot ..... E01H 5/02 294/57
6,269,558 B1 * 8/2001 Alexander ..... E01H 5/02 294/54.5
6,357,148 B1 * 3/2002 Salmonsen ..... A01B 1/22 16/111.1
9,049,918 B2 * 6/2015 Perelli ..... A46B 5/0033
9,120,217 B2 * 9/2015 Fischer, Jr. ..... B25G 1/04
9,340,981 B1 * 5/2016 Gardner ..... E04D 13/106
10,492,352 B1 * 12/2019 Sheth ..... A01B 1/222
2007/0028487 A1 * 2/2007 Larson ..... E01H 5/02 37/278
2009/0013564 A1 * 1/2009 Mallaridas ..... E01H 5/02 37/273
2015/0366122 A1 * 12/2015 Vera Andrades ..... A01B 1/227 294/51

* cited by examiner

SNOW RAKE

CROSS REFERENCE TO RELATED APPLICATION

This is a Continuation-in-Part Application of Non-Provisional Application of Ser. No. 16/130,216 filed Sep. 13, 2018, which is entitled SNOW RAKE.

BACKGROUND OF THE INVENTION

Field of the Invention

This invention relates to a snow rake for moving snow from roofs or similar surfaces. More particularly, this invention relates to a snow rake which includes an adjustable V-shaped blade assembly having an elongated pole secured thereto. Even more particularly, this invention relates to a snow rake which may be disassembled and folded to enable the snow rake, in its disassembled form, being able to be placed in a relatively small box for display, shipment or storage.

Description of the Related Art

Many types of snow rakes have been previously provided to enable a home owner or the like to rake accumulated snow from roofs to prevent "an ice dam" from forming along the eaves of a building. To the best of Applicant's knowledge, the majority of the prior art snow rakes include an elongated pole having a transversely disposed rake portion, secured to the upper end thereof. The prior art snow rakes are quite large even when the pole is disconnected from the rake portion. This makes it difficult to place the snow rake in a box which is large and difficult to display, ship or for storage. Further, to the best of Applicant's knowledge, the blades of the prior art snow rakes are straight and not able to be positioned in a V-shape.

Applicant's snow rake of the co-pending application represents an improvement in the snow rake art. The instant invention represents a further improvement in the snow rake art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A rake is disclosed from moving snow from roofs or the like. The rake includes an upstanding and rectangular-shaped base plate, having an upper end, a lower end, a first side edge, a second side edge, an outer side and an inner side. The inner side of the base plate has an internally threaded tube extending therefrom. The inner side of the base plate has a plurality of spaced-apart pole receivers or receptacles formed therein. An upstanding a rectangular first rake member is provided having an outer end, an inner end, an upper end, a lower end, an inner side and an outer side. The inner side of the first rake member is pivotally secured to the first side edge of the base plate. The rake also includes an upstanding and rectangular-shaped second rake member having an outer end, an inner end, an upper end, a lower end, an inner side and an outer side. The inner side of the second rake member is pivotally secured to the second side edge of the base plate. The first and second rake members are selectively pivotally movable between first and second positions with respect to the base plate. The first and second rake members, when in the first position, are substantially parallel to one another in an end-to-end manner and are substantially parallel to the base plate. The first and second rake members, when in the second position, are angularly disposed with respect to one another and are angularly disposed with respect to the base plate.

The invention also includes an elongated and rigid first support arm having an inner end and an outer end with the outer end of the first support arm being pivotally secured to the inner side of the first rake member. The invention also includes an elongated and rigid second support arm having an inner end and an outer end with the outer end of the second support arm being pivotally secured to the inner side of the second rake member.

The rake also includes an elongated hollow tubular clamp having an outer end, an inner end, a first side and a second side. The tubular clamp has first and second spaced-apart supports extending laterally from the first side thereof with the inner end of the first support arm being received between the first and second spaced-apart supports. The inner end of the first support arm is pivotally secured to the first and second supports. The tubular clamp has third and fourth spaced-apart support extending laterally from the second side thereof with the inner end of the second support arm being received between the third and fourth spaced-apart supports. The inner end of the second support arm is pivotally secured to the third and fourth supports. The tubular clamp has a threaded bolt, having inner and outer ends, which extends into the hollow tubular clamp, whereby the inner end of the bolt may engage the pole.

The invention also includes an extension pole, having first and second ends, with the first end of the extension pole being threadably secured to the internally threaded tube extending from the base plate. The extension pole extends through the tubular clamp whereby the inner ends of the first and second support arms may be longitudinally adjustably secured to the extension pole. The extension pole is comprised of a plurality of elongated pole sections, having first and second ends, which may be secured to one another in an end-to-end manner.

The first and second rake members are also pivotally movable to a third position whereby the first and second rake members are parallel to one another and are angularly disposed at a 90 degree angle with respect to the base plate for shipment or storage. In the third position, the inner sides of the first and second rake members face one another.

When the first and second rake members are in the third positions, the pole sections may be inserted into the pole receivers or receptacles for shipment or storage.

The principal object of the invention is to provide an improved snow rake for moving snow from roofs or similar surfaces.

A further object of the invention is to provide a snow rake having first and second rake members which are pivotally received to a base plate with the rake members being pivotally movable to first, second and third positions.

A further object of the invention is to provide a snow rake which may be placed in a position for placement into a box or the like for shipment or storage.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
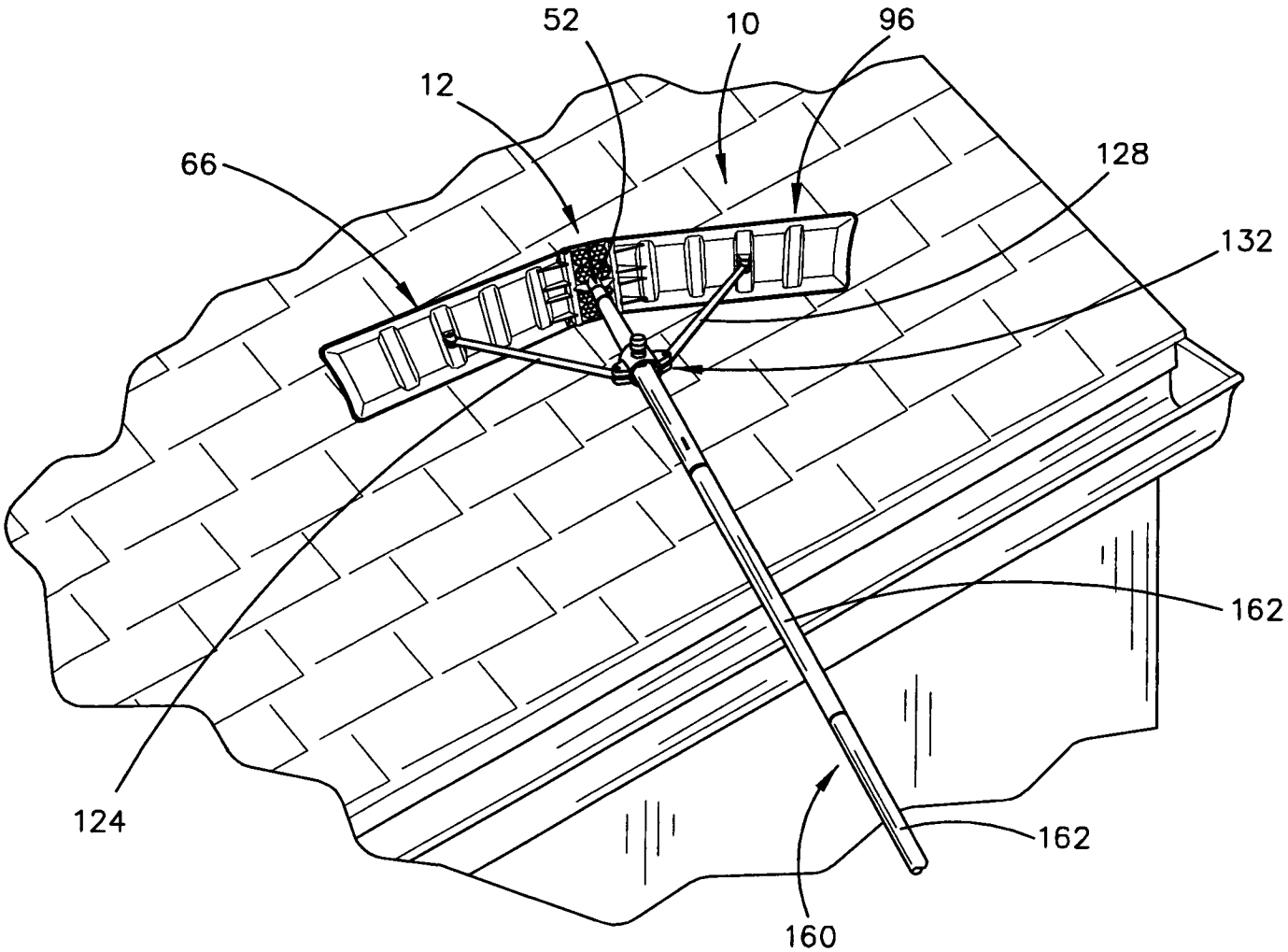
FIG. 1 is a partial perspective view illustrating the snow rake of this invention positioned on the roof of a building.
Figure 2:
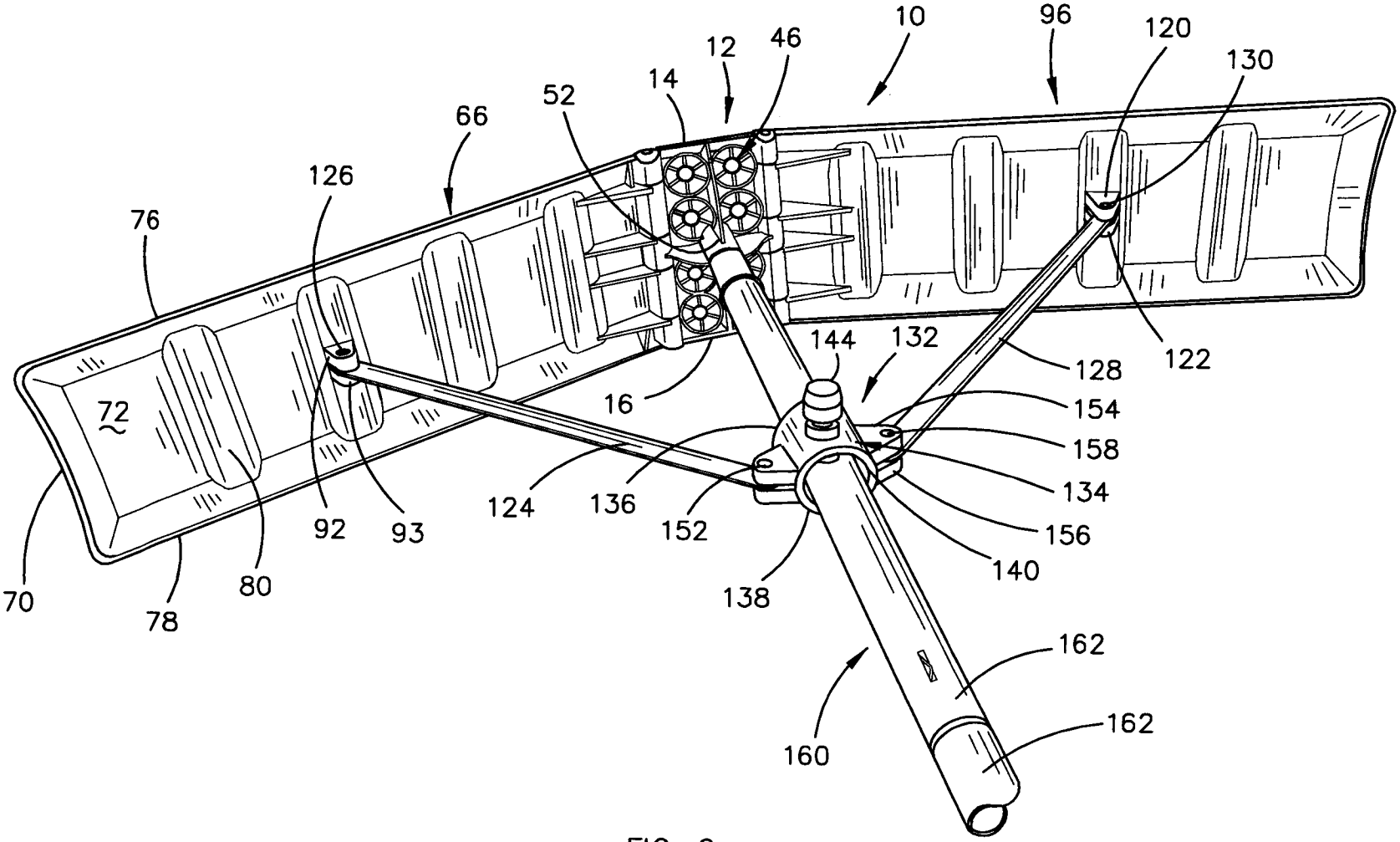
FIG. 2 is a partial rear perspective view of the snow rake of this invention with the rake members thereof being angularly disposed.
Figure 3:
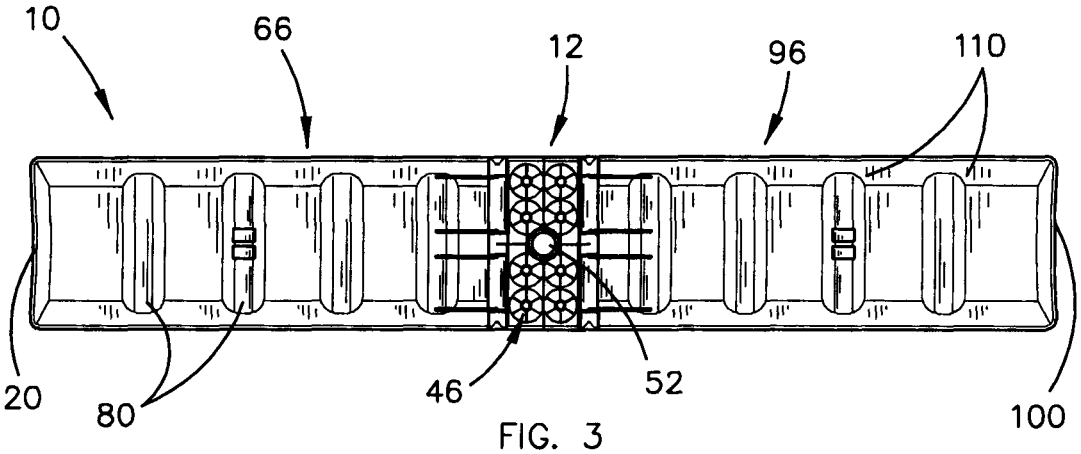
FIG. 3 is a rear view of the rake members and base plate of this invention.
Figure 4:
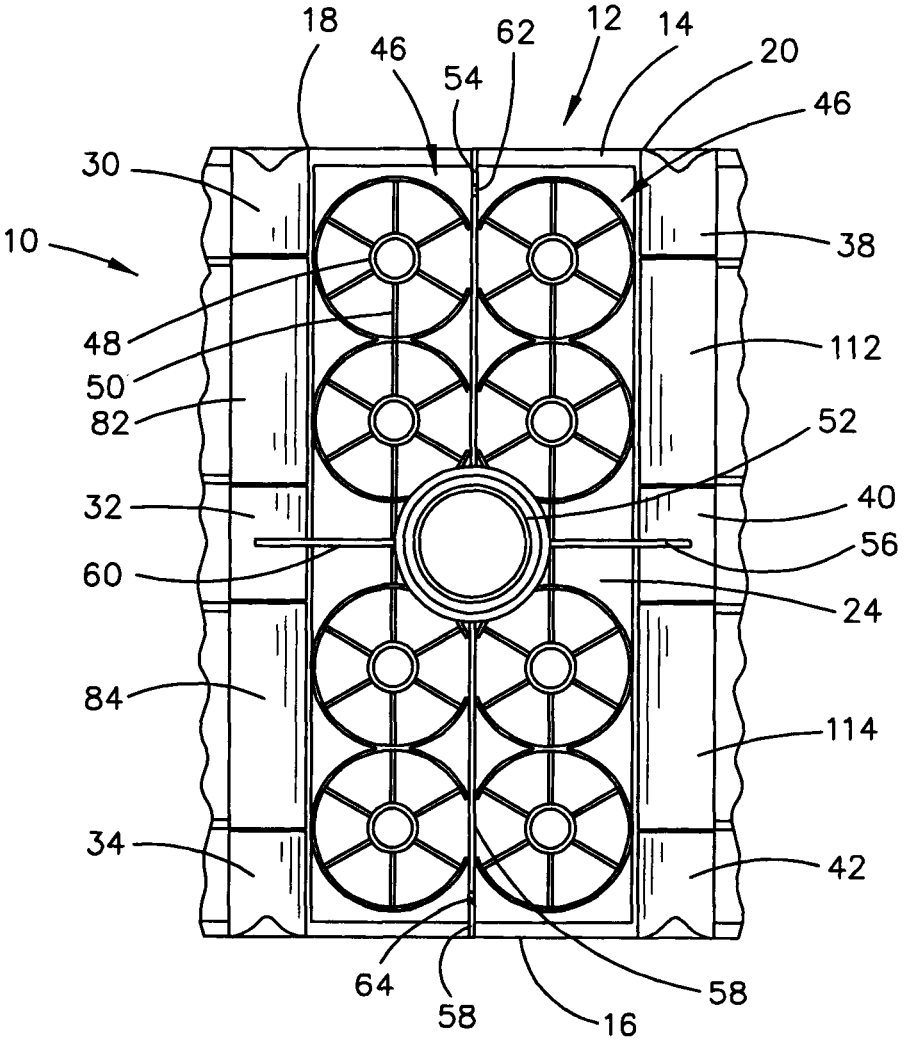
FIG. 4 is a partial rear view illustrating the base plate of this invention and its connection to the rake members of this invention.
Figure 5:
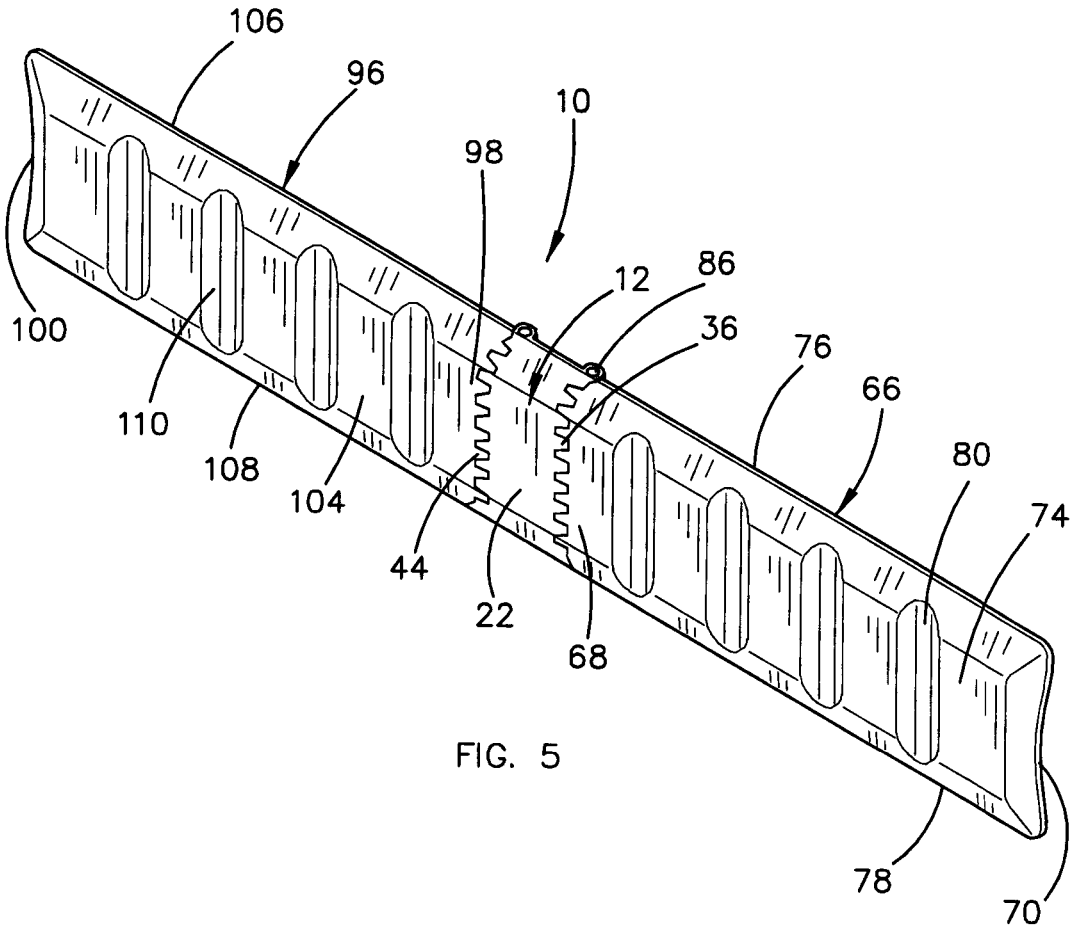
FIG. 5 is a front perspective view of the snow rake members and base plate with the rake members being aligned with the base plate of the invention.
Figure 6:
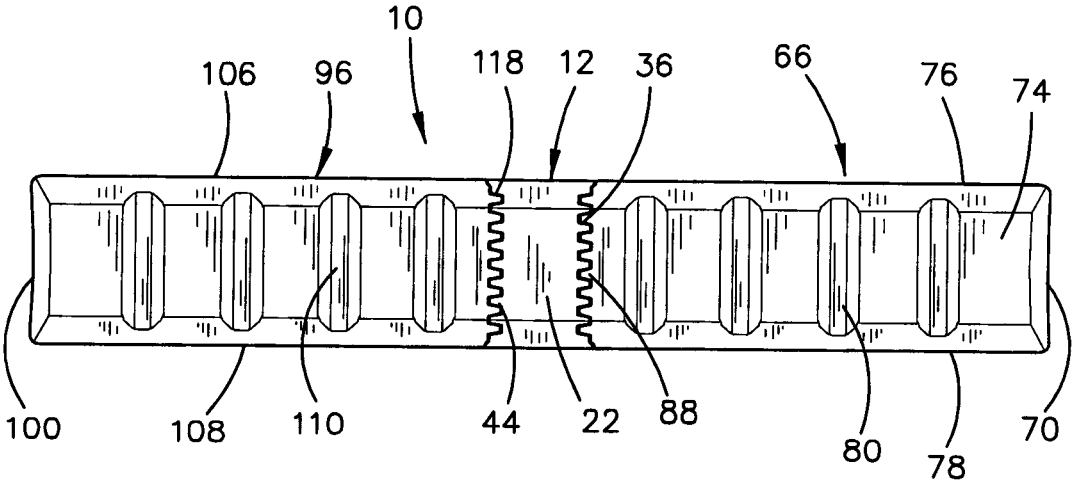
FIG. 6 is a front view of the snow rake members and base plate with the rake members being aligned with the base plate of the invention.
Figure 7:
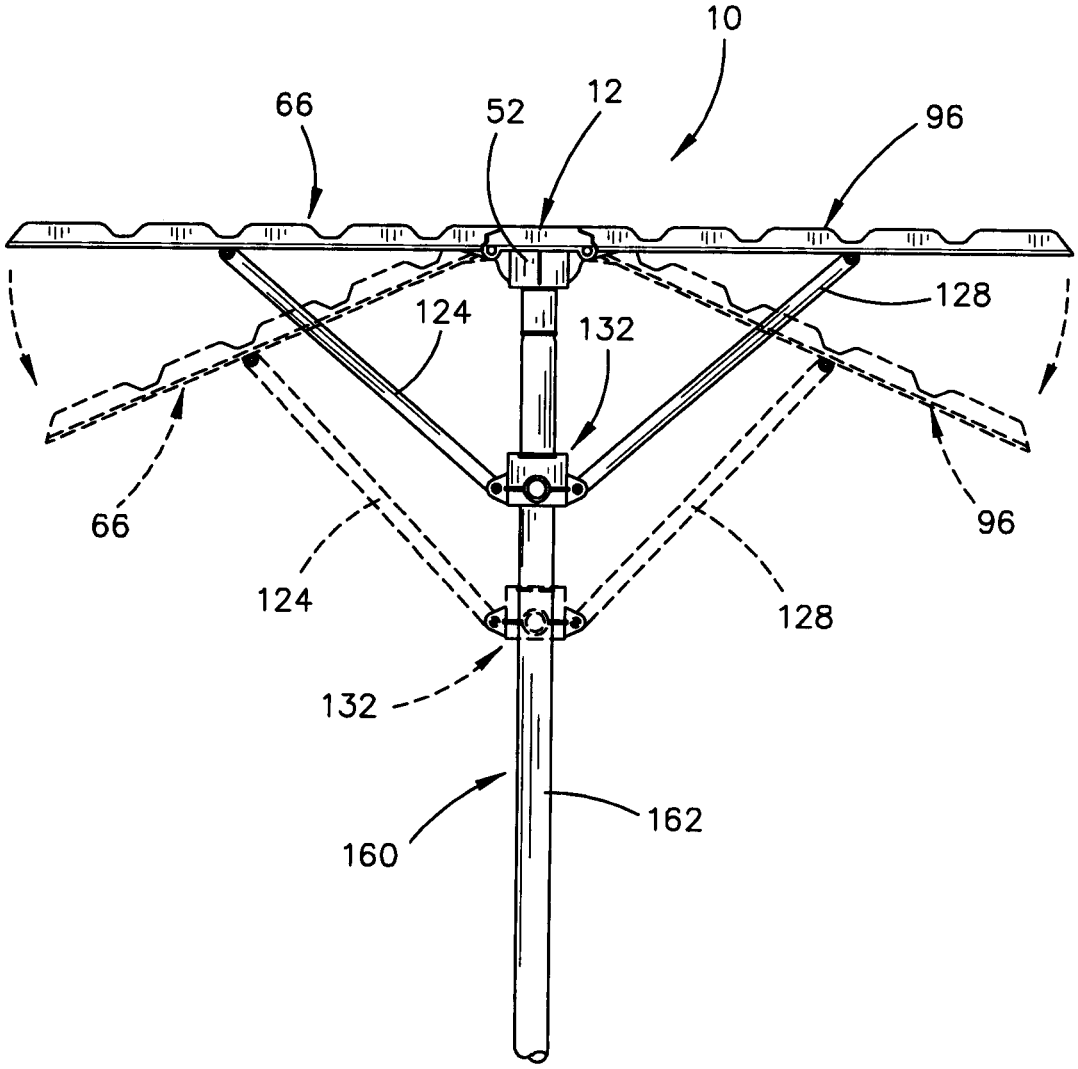
FIG. 7 is a partial upper elevational view of the snow rake members and base plate being aligned and with the broad lines illustrating the snow rake members being angularly disposed with respect to the base plate of the invention.

The numeral 10 refers to the snow rake of this invention. For purposes of clarity, the snow rake 10 will be described as being in the horizontally disposed position rather than as shown in the snow raking position of FIG. 1.

Snow rake 10 includes an upstanding and rectangular-shaped base plate 12 having an upper end 14, a lower end 16, a first side edge 18, a second side edge 20, an outer or forward side 22 and an inner or rearward side 24. As seen, the forward side 22 of base plate 12 has a has a rearwardly curved portion 26 at the upper end thereof and a rearwardly curved position 28 at the lower end thereof. The first side edge 18 of base plate 12 has vertically spaced-apart knuckles 30, 32 and 34 molded therewith at the rearward end thereof. The first side edge 18 of base plate 12 has a plurality of vertically spaced-apart and truncated V-shaped protrusions 36 molded therewith which extend therefrom forwardly of knuckles 30, 32 and 34. The uppermost protrusion 36 is molded with knuckle 30. The middle protrusion 36 is molded with knuckle 32. The lowermost protrusion 36 is molded with knuckle 34.

The second side edge 20 of base plate 12 has a plurality of vertically spaced-apart knuckles 38, 40 and 42 molded therewith at the rearward end thereof. The second side edge 20 of base plate 12 has a plurality of vertically spaced-apart and truncated V-shaped protrusions 44 molded therewith which extend therefrom forwardly of knuckles 38, 40 and 42. The uppermost protrusion 44 is molded with knuckle 38. The middle protrusion 44 is molded with knuckle 40. The lowermost protrusion 44 is molded with knuckle 42.

The rearward or inner side of base plate 12 has a plurality of spaced-apart circular or ring-shaped pole receivers or receptacles 46 which are molded with base plate 12 and which extend rearwardly from the rearward side 24 of base plate 12. Each of the pole receivers 46 has a central tubular member 48 formed therein which has a plurality of radially spaced-apart support arms 50 extending therefrom. The rearward ends of tubular member 48 and support arms 50 are spaced forwardly of the rearward end of the associated receiver 46 to provide a recess therein.

The rearward side 24 of base plate 12 has an internally threaded tube 52 molded therewith which extends rearwardly therefrom. The numerals 54, 56, 58 and 60 refer to tube braces or supports which are molded with base plate 12 and which are secured to tube 52. Supports 54 and 58 have notches 62 and 64 formed therein respectively near the upper and lower ends of supports 54 and 58 respectively.

The numeral 66 refers to a first or left side rake member having an inner side edge 68, an outer side edge 70, a rearward or inner side 72, a forward or outer side 74, an upper end 76 and a lower end 78. The upper end 76 of rake member 66 is curved rearwardly. The lower end 78 of rake member 66 is curved rearwardly. The outer side edge 70 of rake member 66 is curved rearwardly. Rake member 66 is rectangular as seen in the drawings. Rake member 66 has a plurality of strengthening ribs 80 formed therein which are horizontally spaced-apart and vertically disposed. Rake member 66 has vertically spaced-apart knuckles 82 and 84 formed therein at the inner side edge 68 thereof which register with knuckles 30, 32 and 34 of base plate 12. A hinge or pivot pin 86 extends through knuckles 30, 82, 32, 84 and 34 to provide a hinge or pivot between base plate 12 and rake member 66.

The inner side edge 68 of rake member 66 has a plurality of vertically spaced-apart and truncated V-shaped protrusions 88 molded therewith which extend therefrom. Some of the protrusions 88 are molded with knuckles 82 and 84 while the other protrusions 88 are being molded to the inner edge 68 of rake member 66. The protrusions 88 are vertically offset with respect to the protrusions 36 of base plate 12 as will be described hereinafter. Braces 90 and 91 extend between knuckle 82 and the rearward side 72 of rake member 66. Braces 92 and 93 extend between knuckle 84 and the rearward side 72 of rake member 66. A pair of vertically spaced-apart brackets 94 and 95 extends rearwardly from the rearward side 72 of rake member 66 which are positioned inwardly of the inner side edge 68 of rake member 66.

The numeral 96 refers to a second or right rake member which is identical to rake member 66 and which has an inner side edge 98, an outer side edge 100, a rearward or inner side 102, a forward or outer side 104, an upper end 106 and a lower end 108. The upper end 106 of rake member 96 is curved rearwardly. The lower end 108 of rake member 96 is curved rearwardly. The outer side edge 100 of rake member 96 is curved rearwardly. Rake member 96 is rectangular as seen in the drawings. Rake member 96 has a plurality of strengthening ribs 110 formed therein which are horizontally spaced-apart and vertically disposed. Rake member 96 has vertically spaced-apart knuckles 112 and 114 formed therein at the inner side edge 98 thereof which register with knuckles 38, 40 and 42 of base plate 12. A hinge or pivot pin 116 extends through knuckles 38, 112, 40, 114 and 42.

The inner side edge 108 of rake member 96 has a plurality of vertically spaced-apart and truncated V-shaped protrusions 118 molded therewith which extend therefrom. Some of the protrusions 118 are molded with the knuckles 112 and 114 while the other protrusions are molded with the inner side edge 98 of rake member 96. The protrusions 118 are vertically offset with respect to protrusions 44 of base plate 12 as will be described hereinafter. A pair of vertically spaced-apart brackets 120 and 122 extends rearwardly from the rearward side 102 of rake member 96 inwardly of the outer side edge 100.

The forward end of an elongated and rigid arm 124 is positioned between brackets 94 and 95 of rake member 66 and is pivotally secured thereto by a hinge or pivot pin 126. The forward end of an elongated and rigid arm 128 is positioned between brackets 120 and 122 and is pivotally secured thereto by hinge or pivot pin 130.

Figure 9:
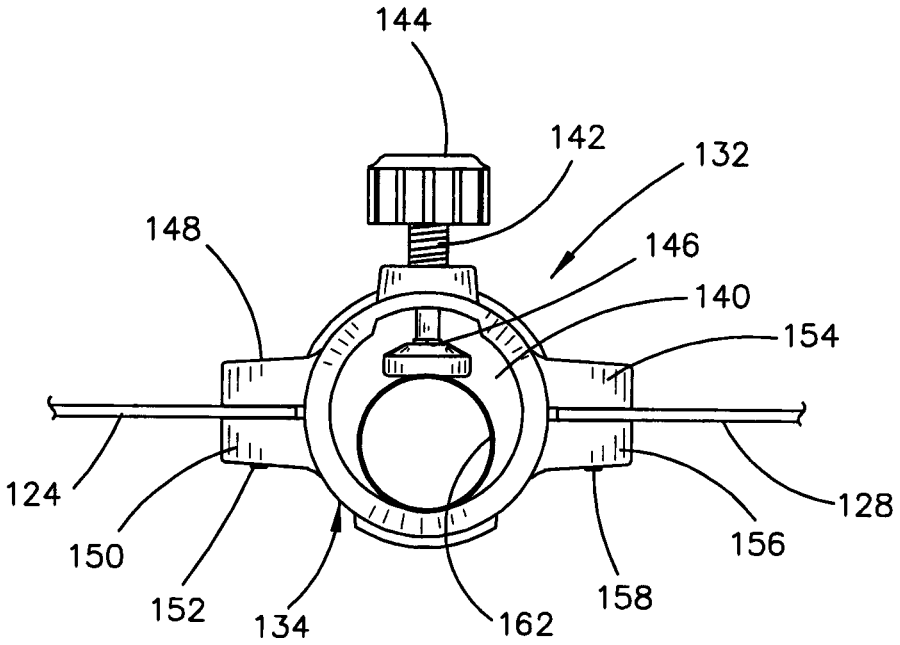
FIG. 9 is a partial end front view of the adjustment clamp of this invention.
Figure 10:
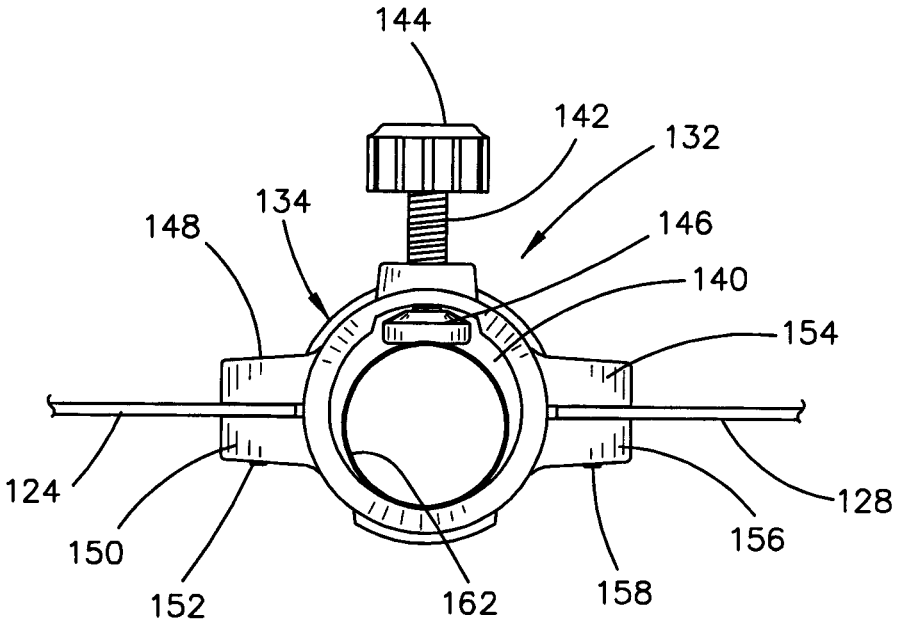
FIG. 10 is a view similar to FIG. 9 except that a larger diameter pole is positioned in the adjustable clamp of the invention.

The numeral 132 refers to the clamp device of this invention. The clamp device 132 includes a body portion 134 having a forward end 136 and a rearward end 138. Body portion 134 has a central bore 140 extending therethrough which has a large diameter so as to have extension poles of various diameters being able to be extended therethrough. A vertically disposed and threaded clamping bolt 142 threadably extends into the bore 140 as seen in FIGS. 9 and 10. Bolt 142 has a knob or handle 144 secured to the outer end thereof. The inner end of bolt 142 has a clamp head 146 mounted thereon which is preferably comprised of rubber or plastic. Body portion 134 has spaced-apart brackets 148 and 150 at one side thereof. The rearward end of arm 124 is received between the brackets 148 and 150 and is pivotally secured thereto by a pivot pin 152. Body portion 134 also has spaced-apart brackets 154 and 156 at the opposite side thereof. The rearward end of arm 128 is received between the brackets 154 and 156 and is pivotally secured thereto by a pivot pin 158.

The numeral 160 refers to an extension pole which is comprised of a plurality of pole sections 162 which may be threadably secured together in an end-to-end manner. The innermost pole section 162 has an externally threaded portion 164 at its inner end which may be threadably secured to tube 52 of base plate 12. The outermost pole section 162 has a handle 166 thereon.

Figure 8:
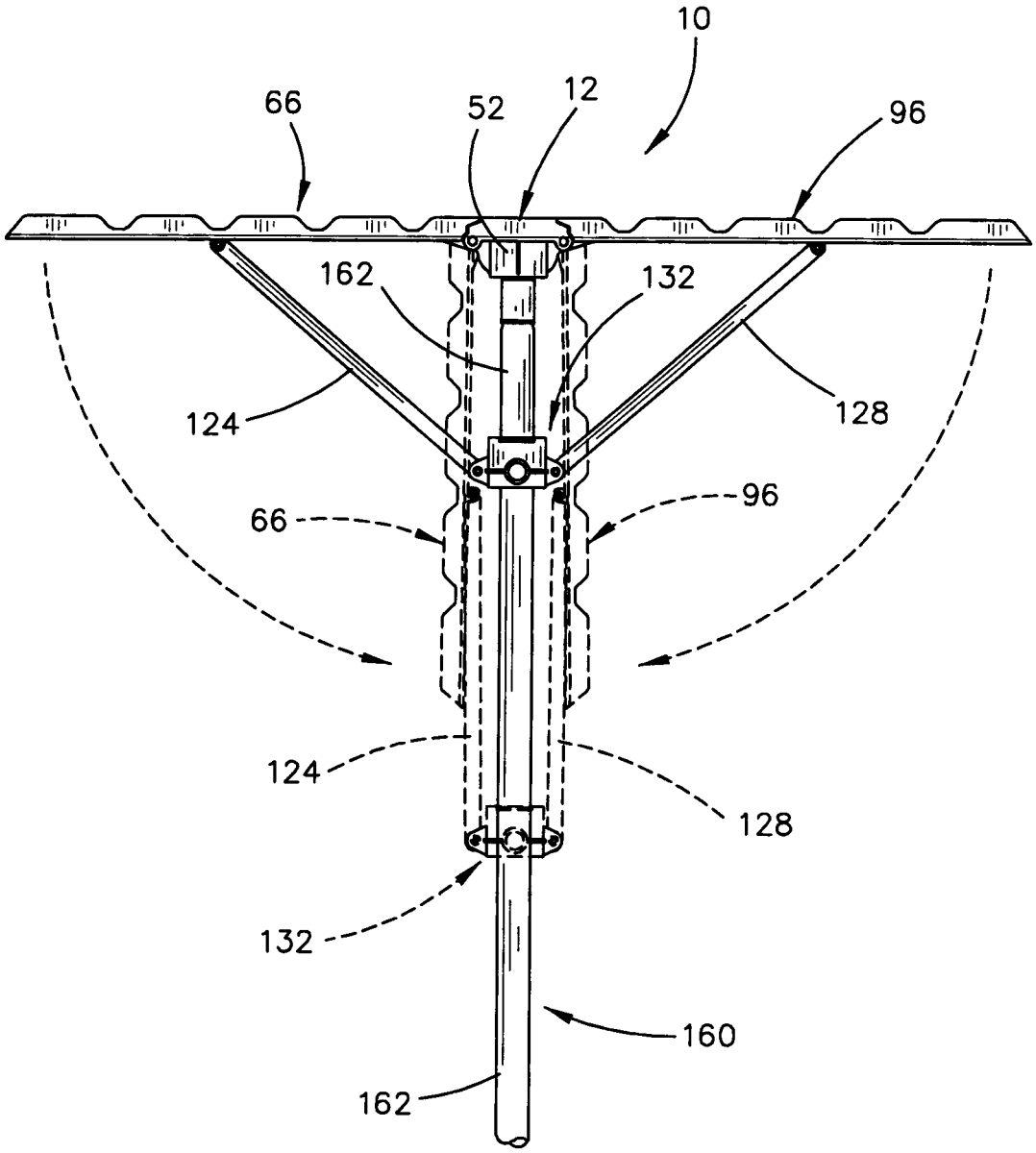
FIG. 8 is a view similar to FIG. 7 except that the snow rake members are shown in broken lines as being in their fully folded positions.
Figure 11:
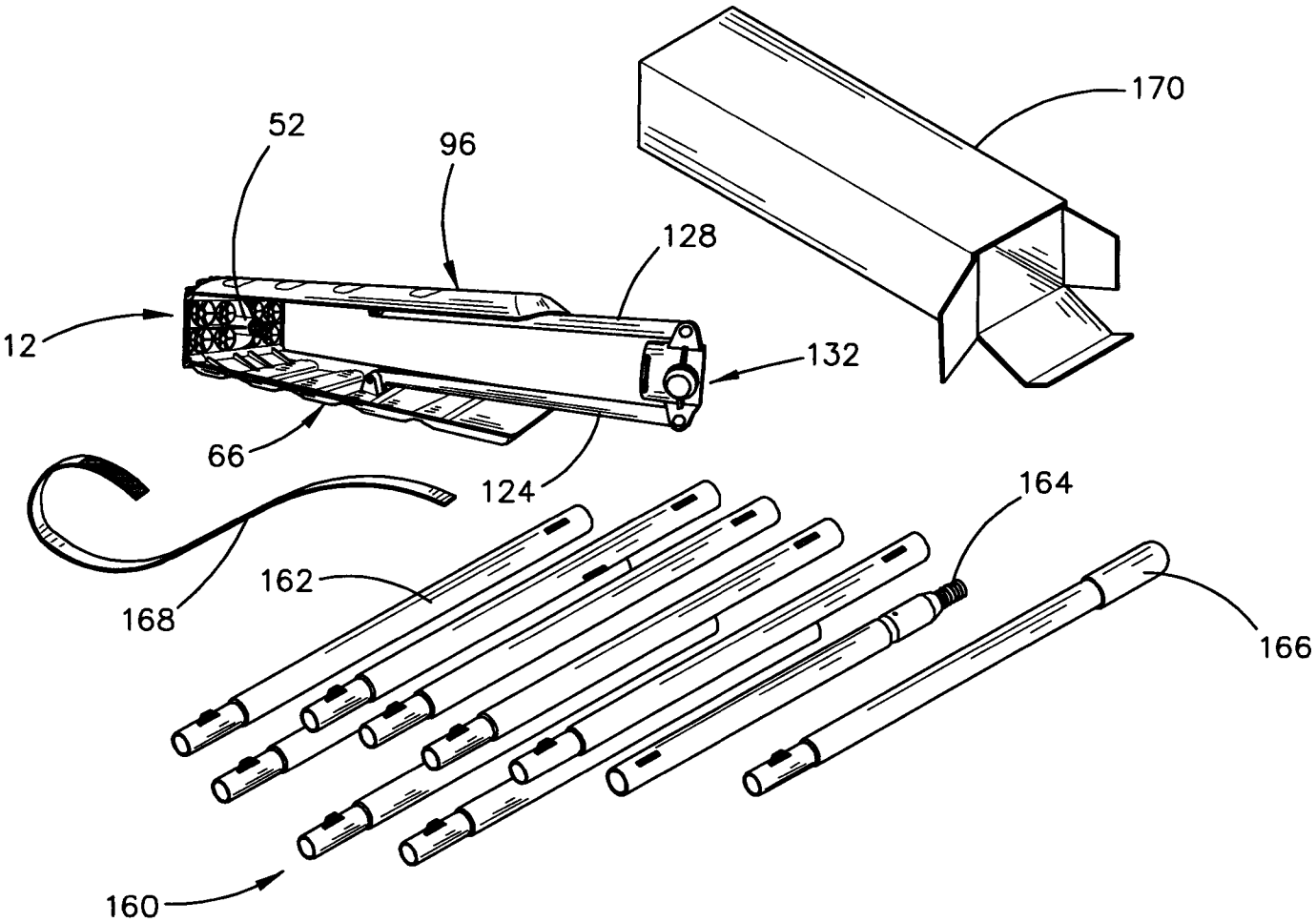
FIG. 11 is an exploded perspective view of the snow rake of this invention and the box into which the snow rake may be inserted for shipment.
Figure 12:
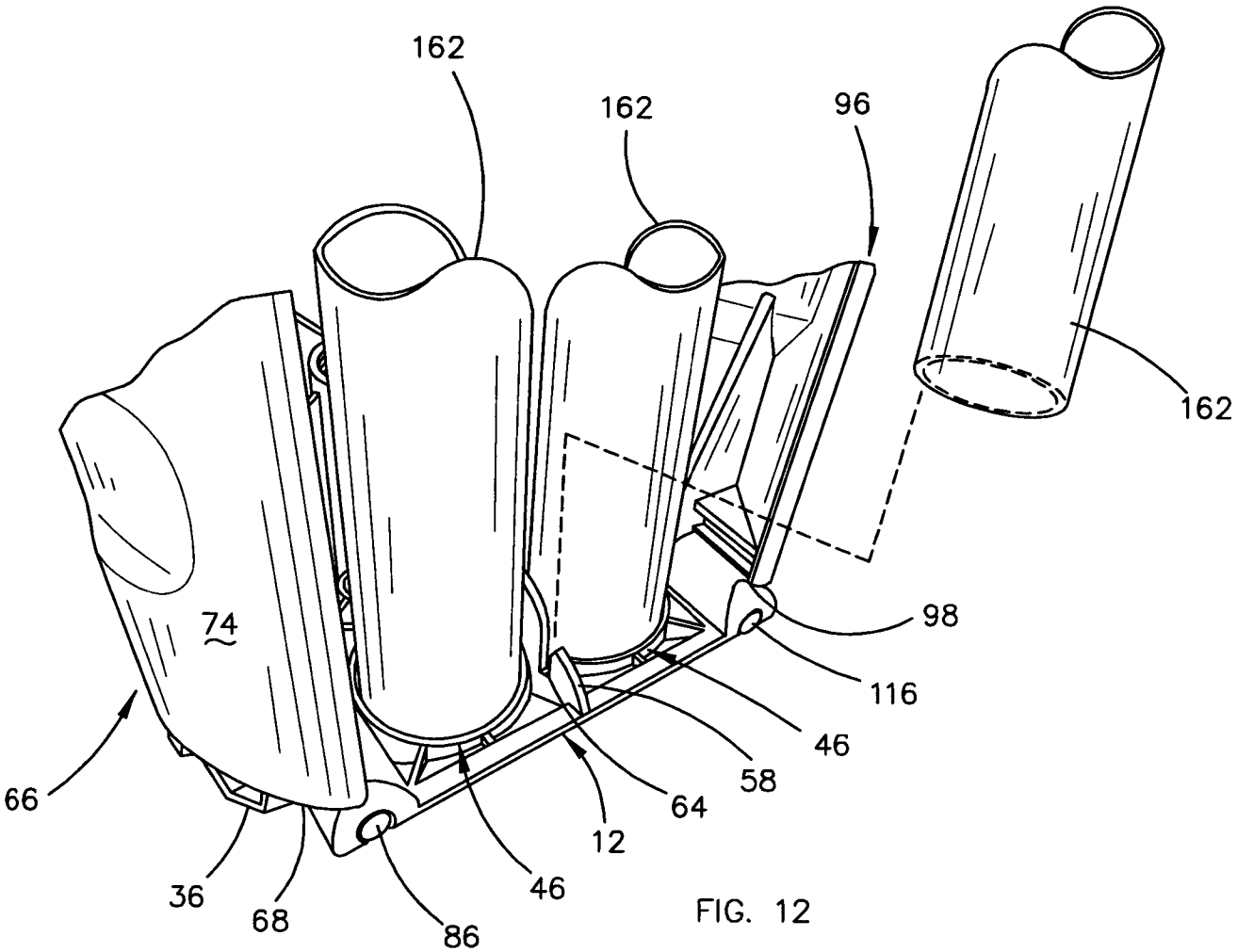
FIG. 12 is a partial rear view illustrating the manner in which the pole sections may be attached to the base plate of the invention for shipment.
Figure 13:
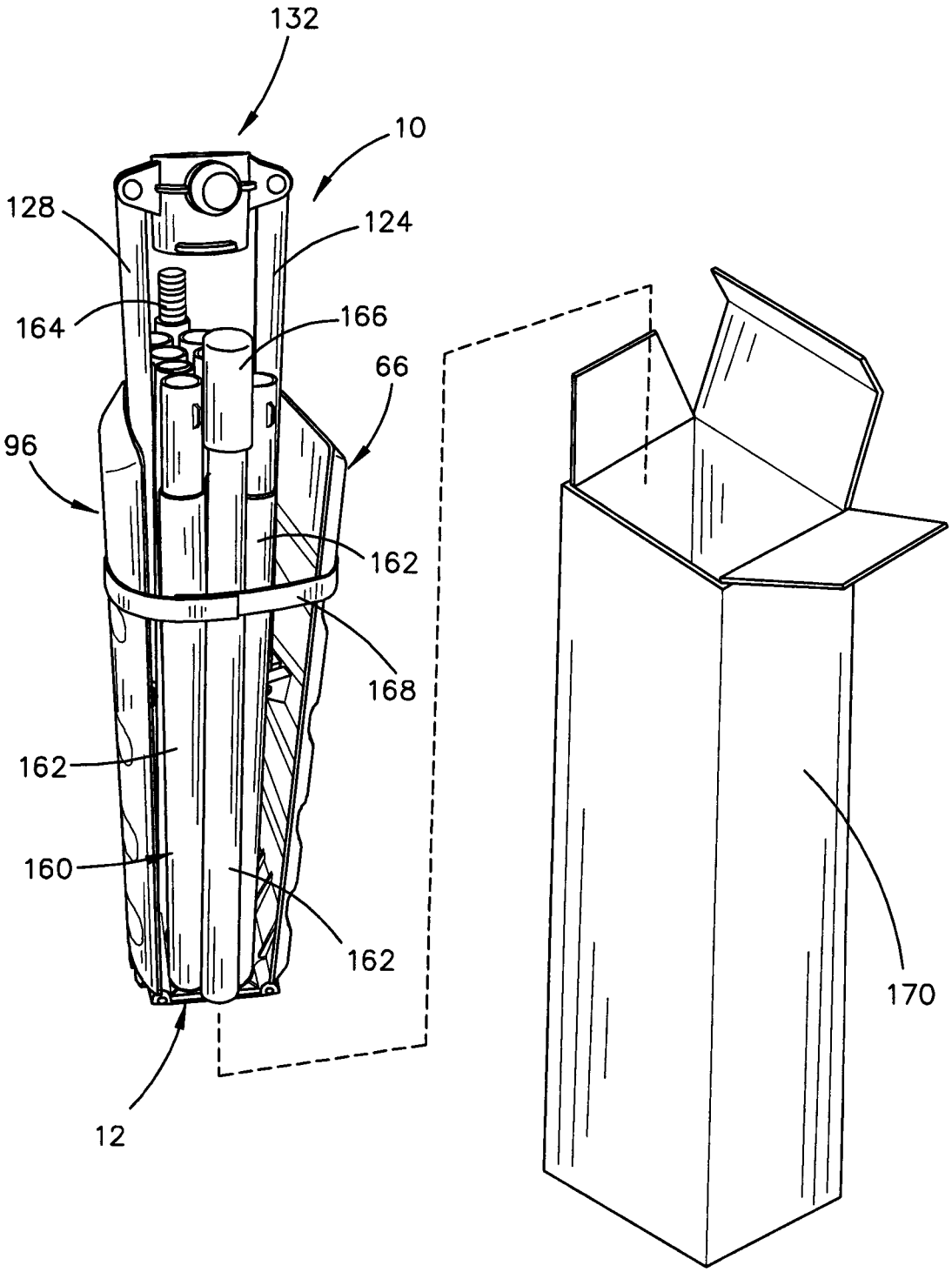
FIG. 13 is a perspective view illustrating the manner in which the snow rake may be positioned in a box for shipment or display purposes.

As seen in the drawings, and as described above, the rake members 66 and 96 may be pivotally movable to first, second and third positions with respect to the base plate 12. In the first position of FIG. 8, the rake members 66 and 96 are parallel to one another and the base plate 12. In the second position of FIGS. 1 and 12, the rake members 66 and 96 are angularly disposed with respect to base plate 12. In the third position of FIGS. 11-13, the rake members 66 and 96 are generally parallel to one another with the inner sides thereof facing one another. In the third position, with the base plate 12 being horizontally disposed, the ends of the pole sections 162 may be inserted into the receptacles 46 as seen in FIG. 12. If the number of pole sections 162 is greater than the number of receptacles 46, the end of one pole section 162 may be inserted into notch 62 on base plate 12 and another pole section 162 may be inserted into notch 64. The strap 168 is then extended around the assembly as seen in FIG. 13 and then inserted into the box 170 as seen at FIG. 13.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A rake for moving snow from roofs, comprising:

an upstanding and rectangular-shaped base plate having an upper end, a lower end, a first side edge, a second side edge, an outer side and an inner side;

said inner side of said base plate having an internally threaded tube extending therefrom;

an upstanding and rectangular-shaped first rake member having an outer end, an inner end, an upper end, a lower end, an inner side and an outer side;

said inner end of said first rake member being pivotally secured to said first side edge of said base plate;

an upstanding and rectangular-shaped second rake member having an outer end, an inner end, an upper end, a lower end, an inner side and an outer side;

said inner end of said second rake member being pivotally secured to said second side edge of said base plate;

said first and second rake members being selectively pivotally movable between first, second, and third positions with respect to said base plate;

said first and second rake members, when in said first position, being substantially parallel to one another in an end-to-end manner and being substantially parallel to said base plate;

said first and second rake members, when in said second position, being angularly disposed with respect to one another and being angularly disposed with respect to said base plate;

said first and second rake members, when in said third position, being parallel to one another with said inner sides thereof facing one another;

an extension pole, having upper and lower ends;

said extension pole being comprised of a plurality of pole sections;

said upper end of said extension pole having an externally threaded member which is selectively threadably and removably secured to said internally threaded tube at said inner side of said base plate;

an elongated and rigid first support arm having an inner end and an outer end;

said outer end of said first support arm being pivotally secured to said inner side of said first rake member;

an elongated and rigid second support arm having an inner end and an outer end;

said outer end of said second support arm being pivotally secured to said inner side of said second rake member;

said first and second support arms, when said first and second rake members are in said third position, being positioned between said inner sides of said first and second rake members;

an elongated hollow tubular clamp having an outer end, an inner end, a first side and a second side;

said tubular clamp having first and second spaced-apart supports extending laterally from said first side thereof;

said inner end of said first support arm being received between said first and second spaced-apart supports;

said inner end of said first support arm being pivotally secured to said first and second supports;

said tubular clamp having third and fourth spaced-apart supports extending laterally from said second side thereof;

said inner end of said second support arm being received between said third and fourth spaced-apart supports;

said inner end of said second support arm being pivotally secured to said third and fourth supports;

said tubular clamp having a threaded bolt, having inner and outer ends, extending into said hollow tubular clamp;

said extension pole extending through said tubular clamp whereby said inner ends of said first and second support arms may be longitudinally adjustably secured to said extension pole;

said first and second rake members when in said third position, said first and second rake members are parallel to one another and are angularly disposed at a 90 degree angle with respect to said base plate for shipment or storage;

said extension pole sections having first and second ends; and said inner side of said base plate having a plurality of spaced-apart extension pole receptacles formed therein which are configured to receive the ends of the elongated pole sections therein when said first and second rake members are in said third position for shipment or storage.

* * * * *